US005232491A

United States Patent [19]

Corrans et al.

[11] Patent Number: 5,232,491

[45] Date of Patent: Aug. 3, 1993

[54] ACTIVATION OF A MINERAL SPECIES

[75] Inventors: Ian J. Corrans, Ballajura; John E. Angove, Duncraig, both of Australia

[73] Assignee: Dominion Mining Limited, Western Australia, Australia

[21] Appl. No.: 902,992

[22] Filed: Jun. 23, 1992

[30] Foreign Application Priority Data

Oct. 25, 1991 [AU] Australia ..... PK9121

[51] Int. Cl.[5] ..... C22B 11/08

[52] U.S. Cl. ..... 75/743

[58] Field of Search ..... 75/743

[56] References Cited

U.S. PATENT DOCUMENTS 4,405,569 9/1983 Dienstbach ..... 423/27

4,552,589 11/1985 Mason et al. ..... 75/105

FOREIGN PATENT DOCUMENTS 8800164 9/1989 Brazil .

*Primary Examiner*—Peter D. Rosenberg

*Attorney, Agent, or Firm*—Merchant, Gould, Smith, Edell, Welter & Schmidt

[57] ABSTRACT

A method of activating a mineral species wherein the mineral species is activated by fine or ultra fine milling prior to processing by methods of oxidative hydrometallurgy. The milled mineral species may be subjected to oxidative leaching under relatively mild conditions of pressure and temperature due to the milling producing minerals which are activated, and which thus react far more readily with oxidants such as oxygen. Furthermore, the oxidative leaching is able to be conducted under conditions requiring less than stoichiometric levels of oxidant, again due to the activated nature of the minerals.

16 Claims, No Drawings

ACTIVATION OF A MINERAL SPECIES

This invention relates to a method for the activation of a mineral species prior to the processing of that mineral species by methods of oxidative hydrometallurgy such as by oxidative leaching.

The mineral species may be such as sulphide minerals, arsenide minerals, telluride minerals, mixed minerals of sulphides, arsenides or tellurides, or any other like mineral species.

The processing methods of oxidative hydrometallurgy are commonly used in many different applications. These applications generally require oxidation conditions of high temperature and pressure and require substantial supplies of oxygen. For example, base metals such as copper, nickel, zinc and others can be recovered by hydrometallurgical processes which usually embody pretreatment, oxidative leaching, solid/liquid separation, solution purification, metal precipitation or solvent extraction and electrowinning.

According to conventional technology, oxidative leaching processes usually require severe physico-chemical conditions in order to achieve acceptable rates of oxidation and/or final recoveries of metal. Under these severe physico-chemical conditions, which often mean temperatures in excess of 200° C. and total pressures in excess of 2000 kPa, the chemical reactions which occur use large quantities of oxygen, both on stoichiometric considerations and in practice where amounts in excess of stoichiometric requirements are used.

An example of oxidative hydrometallurgy is the treatment of refractory gold ores or concentrates. Refractory gold ores are those gold ores from which the gold cannot readily be leached by conventional cyanidation practice. The refractory nature of these gold ores is essentially due to very fine (sub microscopic) gold encapsulated within the sulphide minerals. This gold can often only be liberated by chemical destruction (usually oxidation) of the sulphide structure, prior to recovery of the gold, which is usually done by dissolution in cyanide solution. Of course, other lixivants such as thiourea and halogen compounds and the like may also be used.

A number of processing options are available for treating refractory gold ores which contain sulphide minerals like pyrite, arsenopyrite and others. Pressure oxidation, typified by the so-called Sherritt process, is one such process which typically consists of the steps of feed preparation, pressure oxidation, solid/liquid separation, liquid neutralisation and solids recovery and waste management, and solids to gold recovery usually by cyanidation.

An oxygen plant is usually required to supply the substantial levels of oxygen demand during the pressure oxidation step, which is the heart of the Sherritt process. Typically, the conditions for the pressure oxidation step require temperatures in the region of 190° C. to 210° C., a total pressure of 2100 kPa, a pulp density equivalent to 20% to 30% solids by mass, and a retention time of two hours.

The typical oxidative hydrometallurgical processing methods referred to above generally have oxidation reactions that are carried out in multicompartment autoclaves fitted with agitators. In order to withstand the generally highly aggressive conditions of the reactions, the autoclaves are very costly, both to install and maintain. These vessels must be capable of withstanding high pressure, and linings of heat and acid resistant bricks need to be used. The agitators are made of titanium metal, and the pressure relief systems utilised are also costly and require high maintenance. These high costs and the sophistication of the technology (skilled operators are generally required) detract from the wider acceptance of high pressure/high temperature oxidation, particularly for use in remote areas or by small to medium size operators.

It is an aim of the present invention to avoid, or at least partly alleviate, the difficulties and expenses referred to above with traditional processing methods of oxidative hydrometallurgy, and in particular with the oxidative leaching of a mineral species.

The present invention provides a method of activating a mineral species wherein the mineral species is activated by fine or ultra fine milling prior to processing by methods of oxidative hydrometallurgy. The milled mineral species may be subjected to oxidative leaching under relatively mild conditions of pressure and temperature due to the milling producing minerals which are activated, and which thus react far more readily with oxidants such as oxygen. Furthermore, the oxidative leaching is able to be conducted under conditions requiring less than stoichiometric levels of oxidant, again due to the activated nature of the minerals.

Accordingly, the present invention also provides a method of processing a mineral species which comprises the steps of fine or ultra fine milling of the mineral species, and oxidative leaching of the milled mineral species under relatively mild conditions of pressure and temperature and in the presence of substoichiometric levels of oxidant.

In particular, the present invention provides a method of processing a sulphide mineral, said method comprising the steps of fine milling the sulphide mineral in a vertical stirred mill to P80 of 15 micron or less and leaching the milled sulphide mineral with substoichiometric levels of oxygen at a temperature below about 120° C. and an oxygen pressure below about 1000 kPa.

While the present invention is applicable to any mineral species such as sulphide minerals, arsenide minerals, telluride minerals, or mixed minerals of sulphides, arsenides or tellurides, the invention is particularly useful for the activation and subsequent leaching of sulphide minerals. Accordingly, the following description will be limited by reference to sulphide minerals only. However, it is to be appreciated that this is not to limit the scope of the present invention.

The fine or ultra fine milling of sulphide minerals produces a product in which the sulphides are activated, and which subsequently react far more readily with oxidants such as oxygen. The activation of the sulphide minerals is not fully understood, although it is expected to be a result of a number of factors, such as an increase in the surface area, a reduction in linear dimensions, the straining of crystal lattices, the exposure of regions of high activity in the lattice, and the enhancement of so-called "galvanic" effects.

A preferred type of apparatus which may be suitable for producing fine or ultra fine sulphides in activated form is a vertical stirred mill. However, it will be appreciated that other types of comminution apparatus may also be used to provide the fine or ultra fine milling of the invention.

In the preferred form, vertical stirred mills generally consist of a tank filled with small diameter grinding media (for example 6 mm diameter steel or ceramic balls) which are agitated by means of a vertical shaft usually fitted with horizontal arms. The sulphide minerals (usually contained in the form of a concentrate) are milled by the sheering action produced by ball to ball contact, or between balls and the stirrer or balls and the walls of the tank. The milling may be carried out dry or wet. These vertical stirred mills have been found to be satisfactory in providing the required degree of fineness, and in satisfying energy and grinding media consumption requirements. Furthermore, the activity of the ground product as measured by its response to subsequent oxidation, has also found to be satisfactory. In this respect, a ground product size of P80 of 30 microns or less is preferred, with particular benefits being found with a P80 between 2 and 15 microns.

The relatively mild conditions of pressure and temperature in the oxidative leach that follows the milling, are low when compared with the relatively high pressure and temperature conditions of known pressure oxidation techniques such as the Sherritt process. As indicated above, the Sherritt process typically requires temperatures in the order of 190° to 210° C. and total pressures in the order of 2100 kPa. However, the activation of the mineral species in accordance with the present invention allows the oxidative leach to be conducted at temperatures below about 120° C. and with oxygen pressures below about 1000 kPa.

With the preferred operating conditions being at about 60° to 100° C. and an oxygen pressure of about 900 kPa, a relatively low cost reactor, being polypropylene lined mild steel or stainless steel, is sufficient. There also is no need for the use of titanium metal agitators. Furthermore, abrasion problems are substantially reduced as are settling problems, due primarily to the fine nature of the feed. Further still, the heat exchange and pressure let down systems are simple and low cost and the fast kinetics of the subsequent reactions make possible the use of low cost pipe reactors.

The activation of the mineral species also substantially reduces the oxygen requirements during leaching of the milled product which in turn reduces both capital and operating costs. Furthermore, neutralisation costs are reduced because of the reduced production of sulphuric acid, particularly when the mineral species is a sulphide mineral. Indeed, with use of the present invention in relation to sulphide minerals and with the milder conditions in the oxidation stage, oxidation of all of the sulphides does not proceed to completion. It has been established by X-ray diffraction techniques that the residues produced from the leaching of sulphide minerals in accordance with the present invention contain elemental sulphur, together with various oxides and hydroxides of iron.

In this respect, the oxidation of sulphide to elemental sulphur probably proceeds according to the following reaction:

$$S^{2-} \rightarrow S^{o} + 2e^{-}$$

Oxygen accepts the electrons according to $$2H^{+} + 2e^{-} + 1/2O_2 \rightarrow H_2O$$

Thus for partial oxidation of sulphide sulphur to elemental sulphur, 1 mass unit of sulphur (as sulphide) requires approximately 0.5 mass unit of oxygen. For the total oxidation of sulphide to sulphate, i.e. $S^{2-} + 2O_2 \rightarrow SO_4^{2-}$, the approximate mass ratio is one sulphur to two oxygens. Thus, there is a potential theoretical saving of oxygen of a factor of four by carrying out partial oxidation, although this theoretical saving generally cannot be achieved since some sulphide sulphur is totally oxidised. However, tests have demonstrated reductions in the usage of oxygen compared to conventional technology of factors of two to three, with the exact reduction being dependent primarily on the mineralogy of the material being oxidised. In this respect, some sulphides, for example pyrrhotite, are more readily oxidised than other sulphides and usually form sulphates.

Tests carried out under the conditions of the present invention have also indicated that iron is usually selectively precipitated and remains in the leach residue as goethite, haematite or some form of hydrated oxide, whilst valuable minerals like nickel, copper or zinc remain in solution. This is a further advantage of the current invention over existing technologies, such as acidic ferric chloride or acidic ferric sulphate oxidative leaching, where substantial quantities of iron remain in solution. Iron which remains in solution has to be selectively removed by some other means, prior to recovery of valuable metal, which contributes to extra, unwanted processing costs.

The present invention will now be described in relation to four examples. However, it will be appreciated that the generality of the invention as described above is not to be limited by the following description.

EXAMPLE ONE

A refractory ore from Western Australia yielded about 20% gold recovery when treated by conventional cyanidation technology.

A flotation concentrate produced from this ore contained the minerals pyrite ($FeS_2$) and arsenopyrite (FeAsS). About 80% of the gold was submicroscopic in form (less than 1 micron) and was locked within the arsenopyrite. The flotation concentrate itself typically contained 90%-95% of the gold from the original ore feed sample. Conventional cyanidation of the flotation concentrate typically only yielded 15%-20% of its contained gold being the free particulate gold which reported to the concentrate. Even after ultra-fine milling of the concentrate to P80=5 micron, the incremental recovery of gold amounted to less than 5%.

Conventional pressure oxidation of the concentrate was carried out at the following conditions:

200° C.
2100 kPa total pressure
900 kPa Oxygen partial pressure
1 hr retention time
25% solids by weight The solids were recovered by filtration and washing and then treated by conventional cyanidation. Gold recovery was in excess of 98%, due to the destruction of the sulphides and liberation of the sub-microscopic gold. Oxygen consumption during this conventional oxidative leach amounted to 330 kg oxygen per tonne of concentrate, or approximately 110% of the stoichiometric requirement for oxidation of all sulphide to sulphate.

The same concentrates were milled to a size of 100% passing 15 micron in a vertical stirred mill similar to that described above, having a batch chamber of 5 litres and a continuous chamber of 15 litres. The milled pulp was directly transferred to a reaction vessel and oxidised at a temperature below 100° C. and an oxygen overpressure below 1000 kPa. The reaction was exothermic and became autogenous with respect to heat production. Subsequent cyanidation of the washed residue gave 99% gold extraction.

Oxygen consumption during this mild oxidation was 75 kg oxygen per tonne of concentrate, i.e. about 22% of the oxygen requirement of the conventional technology. Elemental sulphur, goethite and other hydrated oxides of iron occurred in the residue after mild-oxidative leaching.

Under the above mild conditions of oxidation, the following chemical reactions predominate:

Pyrite $$FeS_2+2O_2 \rightarrow FeSO_4+S^0$$

Arsenopyrite $$2FeAsS+7/2O_2+2H_2SO_4+H_2O \rightarrow 2H_3AsO_4+2FeSO_4+2S^0$$

The formation of elemental sulphur does not retard the reaction because of the very small linear dimensions of the feed particles. The reaction temperature is below the melting point of sulphur, hence sulphur does not coalesce and coat mineral or gold particles or interfere with oxidation or subsequent cyanidation.

Other ores or concentrates of metal sulphides which contain gold can be treated according to this invention. These concentrates can be treated to remove metals, e.g. copper, which interfere with cyanidation or any other method of subsequent gold recovery.

EXAMPLE TWO

A concentrate containing 15% copper (as chalcocite) 35% iron (as pyrite) and 90 ppm gold was fine milled to a size of 100% passing 15 micron, again in a vertical stirred mill. Subsequent mild pressure oxidation at a temperature below 100° C. and an oxygen overpressure below 1000 kPa, dissolved approximately 99% of the copper, 2% of the iron and virtually 0% of the gold. The soluble copper was washed from the leach residue, which could then be cyanide leached for its gold content, using economical amounts of cyanide and yielding a gold extraction in excess of 90%.

EXAMPLE THREE

A nickel concentrate containing 22% nickel (as pentlandite), 26.2% iron and 22% sulphide sulphur was milled to a size of 100% passing 15 micron in a vertical stirred mill.

The milled pulp was oxidatively leached at a temperature below 120° C. and an oxygen overpressure below 1000 kPa. Greater than 90% of the nickel was dissolved while less than 3% of the iron was dissolved.

The consumption of oxygen during the above test was 1.1 kg of oxygen per kg of nickel leached, i.e. about 50% of the conventional technology which requires oxidation under severe conditions of temperature and pressure and utilises a minimum of 2.1 kg of oxygen per kg of nickel leached.

EXAMPLE FOUR

A copper concentrate containing 29% copper (as chalcopyrite), 29% iron and 32% sulphide sulphur was milled to a size of 100% passing 15 micron in a vertical stirred mill.

The milled pulp was oxidatively leached at a temperature below 120° C. and an oxygen overpressure below 1000 kPa.

Greater than 90% of the copper was dissolved while less than 3% of the iron was dissolved.

Oxygen consumption was 0.99 kg of oxygen per kg of copper leached. However, when the above copper concentrates were treated in three stages (namely, by milling, leaching, re-milling, re-leaching and further re-milling and re-leaching) then the consumption of oxygen was 0.35 kg of oxygen per tonne of copper leached. This illustrates that a multiple-stage system may advantageously be used to further reduce the consumption of oxygen.

When the above copper concentrates were treated by conventional high temperature/high pressure leaching, the consumption of oxygen was 2.41 kg of oxygen per kg of copper leached.

A similar result has been obtained with a zinc concentrate containing 50% zinc (as sphalerite). High extraction of zinc, low extraction of iron and low usage of oxygen was observed.

It will be appreciated that there may be other variations and modifications to the methods described above that also fall within the scope of the present invention.

The claims defining the invention are as follows:

1. A method of preparing a mineral species for oxidative hydrometallurgy comprising the step of milling the species to P80 of about 30 microns or less.

2. A method according to claim 1 wherein the mineral species is a sulphide mineral, an arsenide mineral, a telluride mineral, or a mixed mineral comprising one or more of the group consisting of sulphides, arsenides and tellurides.

3. A method according to claim 1 wherein the milling is conducted in a vertical stirred mill.

4. A method according to claim 1 wherein the mineral species is a sulphide mineral and the oxidative hydrometallurgy is an oxidative leach.

5. A method according to claim 4 wherein the oxidative leach is conducted at relatively mild temperature and pressure and with low levels of oxidant.

6. A method according to claim 5 wherein the oxidative leach is conducted at temperatures below about 120° C., oxygen pressures below about 1000 kPa and with substoichiometric levels of oxygen as oxidant.

7. A method according to claim 1 wherein the method of oxidative hydrometallurgy is an oxidative leach conducted at relatively mild temperature and pressure and with low levels of oxidant.

8. A method according to claim 1 wherein the milling reduces the size of the mineral species to P80 of 15 micron or less.

9. A method according to claim 1 wherein the milling and subsequent processing are repeated in multiple stages.

10. A method of processing a mineral species, said method comprising the steps of milling the mineral species to P80 of about 30 microns or less, and oxidative leaching of the milled mineral species under relatively mild conditions of pressure and temperature and in the presence of substoichiometric levels of oxygen.

11. A method according to claim 11 wherein the milling is conducted in a vertical stirred mill.

12. A method according to claim 11 wherein the mineral species is a sulphide mineral, an arsenide mineral, a telluride mineral, or a mixed mineral comprising one or more of the group consisting of sulphides, arsenides and tellurides.

13. A method according to claim 11 wherein the oxidative leach is conducted at temperatures below about 120° C. and oxygen pressures below about 1000 kPa.

14. A method according to claim 11 wherein the milling reduces the size of the mineral species to P80 of 15 micron or less.

15. A method according to claim 11 wherein the steps of milling and oxidative leaching are repeated in multiple stages.

16. A method of processing a sulphide mineral, said method comprising the steps of fine milling the sulphide mineral in a vertical stirred mill to P80 of 15 micron or less and leaching the milled sulphide mineral with substoichiometric levels of oxygen at a temperature below about 120° C. and an oxygen pressure below about 1000 kPa.

* * * * *